US010199142B2

(12) United States Patent
Furukawa et al.

(10) Patent No.: US 10,199,142 B2
(45) Date of Patent: Feb. 5, 2019

(54) INSULATED WIRE

(71) Applicants: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

(72) Inventors: Toyoki Furukawa, Mie (JP); Hayato Ooi, Mie (JP); Hiroshi Hayami, Osaka (JP); Kenji Hori, Kanuma (JP)

(73) Assignees: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/559,878

(22) PCT Filed: Mar. 15, 2016

(86) PCT No.: PCT/JP2016/058119
§ 371 (c)(1),
(2) Date: Sep. 20, 2017

(87) PCT Pub. No.: WO2016/158377
PCT Pub. Date: Oct. 6, 2016

(65) Prior Publication Data

US 2018/0061526 A1 Mar. 1, 2018

(30) Foreign Application Priority Data

Mar. 31, 2015 (JP) ..... 2015-072900

(51) Int. Cl.
*H01B 3/00* (2006.01)
*H01B 5/08* (2006.01)
(Continued)

(52) U.S. Cl.
CPC ..... *H01B 7/1895* (2013.01); *H01B 1/026* (2013.01); *H01B 3/445* (2013.01); *H01B 7/18* (2013.01);
(Continued)

(58) Field of Classification Search
CPC ..... H01B 5/08; H01B 3/00
(Continued)

(56) References Cited

U.S. PATENT DOCUMENTS 6,448,502 B2 * 9/2002 Reynolds ..... H01B 7/0009 174/128.1
2007/0187134 A1 * 8/2007 Detian ..... C22F 1/08 174/126.1
2016/0351299 A1 12/2016 Ooi

FOREIGN PATENT DOCUMENTS

JP H01150314 U 10/1989
JP 2007172928 A 7/2007
(Continued)

OTHER PUBLICATIONS

International Search Report for Application No. PCT/JP2016/058119 dated May 10, 2016; 6 pages.
(Continued)

*Primary Examiner* — Chau N Nguyen
(74) *Attorney, Agent, or Firm* — Reising Ethington, P.C.

(57) ABSTRACT

An insulated wire that has a stranded wire conductor, and an insulator that covers an outer circumference of the stranded wire conductor. The stranded wire conductor is made up of at least a plurality of copper-based element wires twisted together, and has been heat-treated after circular compres-
(Continued)

sion. The copper-based element wire(s) has (have) an Ni-based plated layer on the surface. The Ni-based plated later has been compressed by the circular compression. The insulator is composed of a cross-linked ethylene-tetrafluoroethylene based copolymer, and has a heating deformation rate in the range of 65% or more, as determined under predetermined conditions using predetermined formulae in conformity with ISO6722.

21 Claims, 2 Drawing Sheets

(51) Int. Cl.

| | |
|---|---|
| ***H01B 7/18*** | (2006.01) |
| ***H01B 1/02*** | (2006.01) |
| ***H01B 3/44*** | (2006.01) |
| ***H01B 13/00*** | (2006.01) |
| ***H01B 7/28*** | (2006.01) |
| *H01B 7/02* | (2006.01) |
| *H01B 5/10* | (2006.01) |
| *H01B 7/00* | (2006.01) |

(52) U.S. Cl.
CPC ..... *H01B 7/2806* (2013.01); *H01B 13/0016* (2013.01); *H01B 5/104* (2013.01); *H01B 7/0009* (2013.01); *H01B 7/02* (2013.01)

(58) Field of Classification Search
USPC ..... 174/128.1, 110 R
See application file for complete search history.

(56) References Cited

FOREIGN PATENT DOCUMENTS

| | | |
|---|---|---|
| JP | 2008091214 A | 4/2008 |
| JP | 2008159403 A | 7/2008 |

OTHER PUBLICATIONS

International Preliminary Report on Patentability for Application No. PCT/JP2016/058119 dated Oct. 12, 2017; 6 pages.
English Translation of International Preliminary Report on Patentability for Application No. PCT/JP2016/058119 dated Oct. 12, 2017; 7 pages.
Japan Patent Office Notice of Reasons for Refusal for Application No. JP2015-072900 dated Jun. 12, 2018; 2 pages.
English Translation of Japan Patent Office Notice of Reasons for Refusal for Application No. JP2015-072900 dated Jun. 12, 2018; 3 pages.

* cited by examiner

INSULATED WIRE

CROSS REFERENCE TO RELATED APPLICATIONS

This application claims the priority of Japanese patent application JP2015-072900 filed on Mar. 31, 2015, the entire contents of which are incorporated herein.

TECHNICAL FIELD

The present invention relates to an insulated wire.

BACKGROUND ART

In the field of vehicles such as automobiles, there is conventionally known an insulated wire including a stranded wire conductor that is formed of a plurality of conductor element wires twisted together and an insulator that covers the outer circumference of the stranded wire conductor.

As the stranded wire conductor, specifically, Patent Document 1 (JP-A-2008-159403) discloses a stranded wire conductor including a stainless element wire and a plurality of bare copper element wires that are twisted together on the outer circumference of the stainless element wire. Further, the document describes a technique for softening copper in which the bare copper element wires is subjected to heat treatment to improve the elongation deteriorated by work-hardening resulted after the bare copper element wires were twisted together and subjected to circular compression.

Meanwhile, as a material for the insulator, for example, a fluororesin such as a tetrafluoroethylene resin (PTFE) and a tetrafluoroethylene-perfluoroalkyl vinyl ether copolymer (PFA), and polypropylene (PP) and the like are known.

SUMMARY

However, the conventional technology is problematic in the following point. That is, in the case where the conventional insulated wire as described above is used in a state of being in contact with high-temperature AT fluid or CVT fluid, the bare copper element wires forming the stranded wire conductor are corroded by a sulfur component, a phosphorus component and others contained in the oil.

In order to prevent the corrosion, it is conceivable to form a Sn plated layer on the surface of the bare copper element wires. However, the melting point of the Sn plate is relatively low. Therefore, due to the heat during the heat treatment for softening copper, the Sn plated layer tends to melt and to easily peel. The same condition occurs also due to the heat in covering the outer circumference of the stranded wire conductor with the insulator. Consequently, the conventional insulated wire is problematic in that due to corrosion of the copper element wires caused by the high-temperature oil, the conductor cross-sectional area of the stranded wire conductor decreases and the shock resistance deteriorates.

Further, in recent years, reduction in wire diameter has been demanded for insulated wires such as automotive wires in order to efficiently perform routing the insulated wires in a small space. For reducing the wire diameter, not only the circular compression of the stranded wire conductor but also reduction in thickness of the insulator is effective. However, the strength of perfluoro resins is low because the cross-linkage is difficult. Thus, the conventional insulated wire is problematic in that the abrasion resistance of the insulator tends to deteriorate if the thickness of the insulator is reduced.

Furthermore, insulated wires such as automotive wires need to withstand being bent at the time of the routing. However, the conventional insulated wire is problematic in that the insulator easily cracks in the case where the insulated wire is exposed to a high-temperature oil as described above with being bent, and is once released from bending, and is once again bent. Here, as one typical example, a case where a wire harness once assembled is reassembled can be exemplified.

The present design has been made in view of such a background, and it is intended to provide an insulated wire that makes it possible to reduce deterioration of the shock resistance due to the corrosion of the copper-based element wire which has been caused by the high-temperature oil composed of AT fluid or CVT fluid, provide the insulator with a good abrasion resistance, and make the insulator hardly crack even in the case where the insulated wire is exposed to the high-temperature oil with being bent, and is once released from bending, and is once again bent.

An aspect of the present design is an insulated wire including: a stranded wire conductor; and an insulator that covers an outer circumference of the stranded wire conductor, wherein the insulated wire is configured to be used in a state of being in contact with an oil composed of AT fluid or CVT fluid, the stranded wire conductor is made up of at least a plurality of copper-based element wires that are twisted together, and has been heat-treated after circular compression, the copper-based element wires have a Ni-based plated layer on a surface thereof, the Ni-based plated layer has been compressed by the circular compression, and the insulator is composed of a cross-linked ethylene-tetrafluoroethylene based copolymer.

The insulated wire includes the stranded wire conductor which is made up of at least the plurality of copper-based element wires twisted together and which has been subjected to circular compression and heat treatment. Further, in the stranded wire conductor, the copper-based element wires have the Ni-based plated layer on the surface, and the Ni-based plated layer has been compressed by circular compression. The melting point of the Ni-based plate is higher than that of a Sn plate. In addition, the melting point of Ni-based plate is higher than the softening temperature of the copper material forming the copper-based element wire and the covering temperature at which the outer circumference of the stranded wire conductor is covered with the insulator. Therefore, in the insulated wire, the Ni-based plated layer hardly melts due to the heat during the heat treatment for softening the copper material or the heat in covering the outer circumference of the stranded wire conductor with the insulator, and also hardly peels. Thus, in the insulated wire, the conductor cross-sectional area of the stranded wire conductor hardly decreases due to the corrosion of the copper-based element wire, which has been caused by the high-temperature oil composed of AT fluid or CVT fluid, and the deterioration of the shock resistance can be reduced.

Further, the insulated wire includes the insulator composed of a cross-linked ethylene-tetrafluoroethylene based copolymer. The cross-linked ethylene-tetrafluoroethylene based copolymer has a high strength, and is excellent in abrasion resistance. Thus, in the insulated wire, the insulator is good in abrasion resistance.

Furthermore, the cross-linked ethylene-tetrafluoroethylene based copolymer hardly deteriorates even in the case of being exposed to the high-temperature oil. Thus, in the insulated wire, the insulator hardly cracks even in the case where the insulated wire is exposed to the high-temperature oil with being bent, and is once released from bending, and is once again bent.

As described above, according to the present, it is possible to provide an insulated wire that makes it possible to reduce the deterioration of the shock resistance due to the corrosion of the copper-based element wire, which has been caused by the high-temperature oil composed of AT fluid or CVT fluid, provide the insulator with a good abrasion resistance, and make the insulator hardly crack even in the case where the insulated wire is exposed to the high-temperature oil with being bent, and is once released from bending, and is once again bent.

MODE FOR CARRYING OUT THE INVENTION

Figure 1:
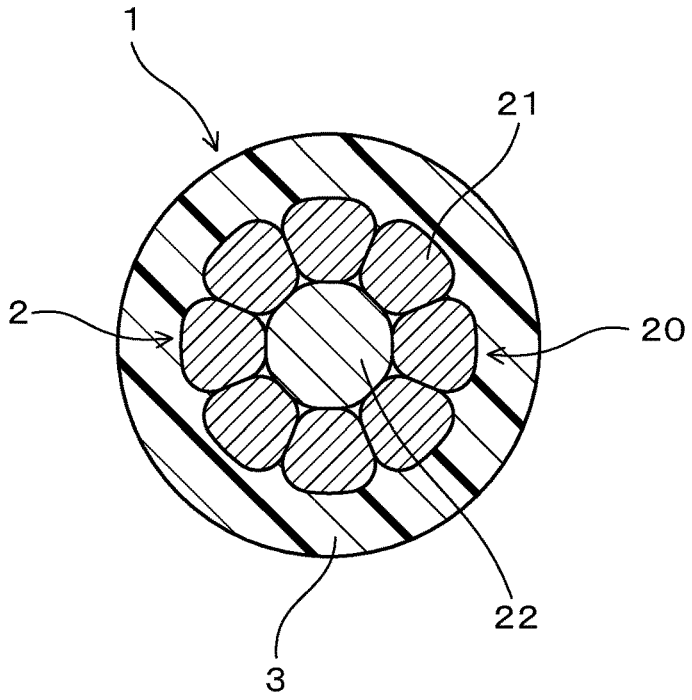
FIG. 1 is a cross-sectional view of an insulated wire according to Example 1.

The insulated wire is intended to be used in a state of being in contact with an oil composed of AT fluid or CVT fluid. The preceding phrase, "used in a state of being in contact with the oil" includes the case where the insulated wire is used in the oil. More specifically, the preceding phrase, "used in the oil" includes not only the case where the insulated wire is immersed in the oil but also the case where the insulated wire is used in an atmosphere containing an oil component such as a volatile component of the oil and misty oil.

In the insulated wire, the stranded wire conductor is made up of at least a plurality of copper-based element wires twisted together, and has been heat-treated after circular compression. The stranded wire conductor has been subjected to the circular compression in a radial direction of the stranded wire, and it is advantageous for reduction in the wire diameter of the insulated wire. Further, in the insulated wire, the stranded wire conductor has been subjected to the heat treatment, and thus deterioration of the shock resistance due to work-hardening of the stranded wire conductor is reduced. Consequently, in the insulated wire, both the deterioration of the shock resistance due to the corrosion of the copper-based element wire caused by the high-temperature oil and the deterioration of the shock resistance due to the work-hardening of the stranded wire conductor can be reduced. As mentioned above, the insulated wire is advantageous from the viewpoint of reducing the deterioration of the shock resistance.

The above-described circular compression, specifically, can be performed, for example, at the time of twisting the copper-based element wires together, or after the twisting. Whether the stranded wire conductor has been subjected to the circular compression can be judged, for example, by observing the conductor cross-section to check for any changes due to the circular compression, on an outer shape of the copper-based element wire that constitutes the outermost layer. Further, whether the stranded wire conductor has been subjected to the heat treatment can be judged by analyzing the chemical component composition of the copper material forming the copper-based element wire, the elongation property and the like. Such analysis has been possible on the basis of finding that copper material which has not been softened after circular compression is poor in elongation property. As one specific example of the heat treatment of the stranded wire conductor, electrical heating can be exemplified.

In the insulated wire, it is preferable that the conductor cross-sectional area of the stranded wire conductor is 0.25 $mm^2$ or less. Because a stranded wire conductor having a conductor cross-sectional area of 0.25 $mm^2$ or less is small in diameter, the stranded wire conductor is easily heated in the heat treatment to be performed after the circular compression. Thus, in the stranded wire conductor having a conductor cross-sectional area of 0.25 $mm^2$ or less, it has conventionally been difficult in particular to use a copper-based element wire having a Sn plated layer formed on the surface thereof, and a bare copper element wire has to be used by necessity. As a result, in an insulated wire including the stranded wire conductor having a conductor cross-sectional area of 0.25 $mm^2$ or less, it has been difficult in particular to reduce corrosion in the case where the insulated wire is exposed to high-temperature oil. However, the aforesaid insulated wire includes the stranded wire conductor configured as described above. Consequently, in the insulated wire, even if the conductor cross-sectional area of the stranded wire conductor is as small as 0.25 $mm^2$ or less, it is unlikely that the conductor cross-sectional area decreases due to the corrosion of the copper-based element wires, which has been caused by the high-temperature oil, and it is possible to surely reduce the deterioration of shock resistance. Moreover, in the case where the conductor cross-sectional area of the stranded wire conductor is 0.25 $mm^2$ or less, the load to be applied to the insulator by bending in the state where the insulated wire is kept bent is small. As a result, the insulator more hardly cracks even in the case where the insulated wire is exposed to the high-temperature oil with being bent, and is once released from bending, and is once again bent.

From the viewpoint of diameter size reduction, weight saving, enhancement of crack resistance in the insulator, and the like, the conductor cross-sectional area of the stranded wire conductor can be preferably set to 0.2 $mm^2$ or less, more preferably set to 0.18 $mm^2$ or less, and further preferably set to 0.15 $mm^2$ or less. Here, from the viewpoint of manufacturability, strength, electric conductivity and the like, the conductor cross-sectional area of the stranded wire conductor can be set to 0.1 $mm^2$ or greater.

In the insulated wire, a base material for the copper-based element wires forming the stranded wire conductor is composed of copper or a copper alloy. Then, each copper-based element wires have a Ni-based plated layer on the surface, and the Ni-based plated layer has been compressed by circular compression. Specifically, the Ni-based plated layer can be formed of a Ni plate or a Ni alloy plate. Here, for plating, electroplating or electroless plating may be employed. From the viewpoint for easily reducing deterioration of the shock resistance due to the corrosion of the copper-based element wires, which has been caused by the high-temperature oil, the thickness of the Ni-based plated layer can be preferably set to 0.1 to 5.0 μm, more preferably set to 0.3 to 3.0 μm, further preferably set to 0.5 to 1.5 μm, and furthermore preferably set to 0.8 to 1.3 μm.

The outer diameter of each copper-based element wire in a state before being subjected to the circular compression, is preferably in a range of 0.1 to 0.15 mm, more preferably in a range of 0.12 to 0.145 mm, and further preferably in a range of 0.13 to 0.14 mm. Here, the abovementioned outer diameter of the copper-based element wire does not include the thickness of the Ni-based plated layer.

Specifically, the stranded wire conductor in the insulated wire can be configured, for example, to have a tension member for resisting tensile force at a conductor center. More specifically, the stranded wire conductor can be configured to have a tension member for resisting tensile force, which is disposed at a conductor center, and an outermost layer that is formed of the plurality of copper-based element wires twisted together on the outer circumference of the tension member.

In this case, even if a tensile force acts on the insulated wire and thereby the stranded wire conductor receives the tensile force acted thereon, the tension member resists against the tensile force, and accordingly the tensile force to be loaded on the copper-based element wires is absorbed. Consequently, in this case, because the insulated wire is enhanced in shock resistance, it is possible to produce an insulated wire in which the copper-based element wire are hardly disconnected due to any shock. Further, as described above, the disconnection caused by corrosion of the copper-based element wires is also reduced, and therefore, an insulated wire exhibiting a sufficient effect for reducing the disconnection can be obtained. The configuration in which the stranded wire conductor has the tension member is particularly advantageous to a small-diameter stranded wire conductor having a conductor cross-sectional area of 0.25 $mm^2$ or less.

As a material for the tension member, for example, iron, stainless, nickel or the like can be used. The material for the tension member is preferably stainless. This is because stainless is advantageous for enhancement of corrosion resistance against a high-temperature oil. Further, it is preferable that the outer diameter of the tension member be greater than the outer diameter of the copper-based element wire in a state before being subjected to the circular compression. Specifically, in a state before being subjected to the circular compression, the outer diameter of the tension member can be preferably 0.2 to 0.3 mm, and more preferably 0.22 to 0.23 mm.

In addition, the stranded wire conductor of the insulated wire, for example, can be configured to have a center copper-based element wire that is disposed at the conductor center, and an outermost layer that is formed of the copper-based element wires twisted together on the outer circumference of the center copper-based element wire. Here, in this case, the center copper-based element has the Ni-based plated layer on the surface thereof. The outer diameter of the center copper-based element may be the same as or different from those of the copper-based element wires that form the outermost layer in a state before being subjected to circular compression. Further, the center copper-based element may be formed from the same copper material as the copper-based element wires, or may be formed from a copper material in which an alloy element is different in kind, proportion and others.

In the insulated wire, the stranded wire conductor preferably includes an outermost layer that is specifically made up of seven or eight copper-based element wires. This configuration brings about the operational effects as described above, and makes it possible to easily provide an insulated wire including a small-diameter stranded wire conductor having a conductor cross-sectional area of 0.25 $mm^2$ or less.

In the insulated wire, the insulator is composed of a cross-linked ethylene-tetrafluoroethylene based copolymer. The ethylene-tetrafluoroethylene based copolymer can include, other than an ethylene unit and a tetrafluoroethylene unit, any other unit composed of a component copolymerizable with ethylene or tetrafluoroethylene. As specific examples of the other unit, a propylene unit, a butene unit, a vinylidene fluoride unit and a hexafluoropropene unit can be exemplified. As the other unit, one kind or two or more kinds of units may be included in the molecular structure of the ethylene-tetrafluoroethylene based copolymer. Further, the insulator may be composed of one kind of cross-linked ethylene-tetrafluoroethylene based copolymer, or may be composed of two or more kinds of cross-linked ethylene-tetrafluoroethylene based copolymers. From the viewpoint of availability and the like, an ethylene-tetrafluoroethylene copolymer composed of the ethylene unit and the tetrafluoroethylene unit can be employed as the ethylene-tetrafluoroethylene based copolymer.

Specific examples of crosslinking of the ethylene-tetrafluoroethylene based copolymer include, for example, a method of performing electron beam irradiation after the outer circumference of the stranded wire conductor is covered with a non-cross-linked ethylene-tetrafluoroethylene based copolymer, and a method of performing heating after the outer circumference of the stranded wire conductor is covered with a non-cross-linked ethylene-tetrafluoroethylene based copolymer combined with an organic peroxide. The former method is preferable. This is because the progress of the cross-linkage is easily controlled by the irradiance level of the electron beam, and which is advantageous in the point of efficient production.

In the insulated wire, the heating deformation rate of the insulator is preferably 65% or more. This is because in such a case, the effects of enhancing the abrasion resistance of the insulator and improving the crack of the insulator can be easily achieved. Here, the heating deformation rate of the insulator is a value that is calculated on the basis of the below-mentioned formula 2 after an edge of 0.7 mm in thickness is pressed against a surface of the insulator with a load defined by Formula 1 as below-mentioned and is kept under an atmosphere at 220° C. for 4 hours in conformity with ISO6722. The increase in the value of the heating deformation rate of the insulator means the increase in the cross-linkage degree of the insulator.

$$\text{Load } [N]=0.8\times\sqrt{\{i\times(2D-i)\}} \quad \text{(Formula 1)}$$

where, D: a finished outer diameter [mm] of the insulated wire, i: a thickness [mm] of the insulator Heating Deformation Rate (%)=100×(Minimum Wire Outer Diameter [mm] after subjected to Heating Deformation−Outer Diameter [mm] of Stranded Wire Conductor)/(Wire Outer Diameter [mm] before being subjected to Heating Deformation−Outer Diameter [mm] of Stranded Wire Conductor) (Formula 2)

The heating deformation rate of the insulator can be preferably 68% or more, more preferably 69% or more, and further preferably 70% or more. Here, from the viewpoint for reducing deterioration of the flexibility, the heating deformation rate of the insulator can be 90% or less.

In the insulated wire, specifically, the thickness of the insulator can be preferably 0.1 mm or more, more preferably 0.12 mm more, and further preferably 0.15 mm or more. In this case, the abrasion resistance is easily secured. Further, specifically, the thickness of the insulator can be preferably 0.4 mm or less, more preferably 0.38 mm or less, and further preferably 0.35 mm or less. In this case, reduction in the thickness of the insulator is easily achieved, and which is advantageous for reducing the wire diameter. Further, the reduction in the thickness of the insulator can easily reduce the load to be applied to the insulator when the insulated wire is bent. Therefore, the insulator more hardly cracks even in the case where the insulated wire is exposed to the high-temperature oil with being bent, and is once released from bending, and is once again bent.

The insulated wire is preferably configured to be used in a state in which a bent portion is formed by bending. This case can effectively provide the operational effects as described above. More specifically, the bent portion can include a 180° bent portion that is formed by 180° bending. This case provides an insulated wire that has the operational effects as described above and that makes efficient routing in a small space possible. The bent portion may be formed at one location, or two or more locations.

In the insulated wire, specifically, the insulator is preferably formed by covering the outer circumference of the stranded wire conductor with the ethylene-tetrafluoroethylene based copolymer through extrusion molding and then crosslinking the ethylene-tetrafluoroethylene based copolymer. The ethylene-tetrafluoroethylene based copolymer, which is a material of the insulator, requires a temperature exceeding 200° C. for the extrusion molding. Even in the case of being exposed to such a temperature, in the insulated wire, the Ni-based plated layer hardly melts and also hardly peels. Thus, in this case, the conductor cross-sectional area of the stranded wire conductor tends not to decrease due to the corrosion of the copper-based element wire, which has been caused by the high-temperature oil, and the deterioration of the shock resistance can be reduced.

In the insulated wire, the insulator may contain one kind or two or more kinds of various addition agents that are added to electric wires for ordinary use. Specific examples of the addition agent include bulking agents, flame retardants, antioxidants, age inhibitors, lubricants, plasticizers, copper inhibitors, and pigments.

Here, the above-described configurations can be combined as needed, for example, for obtaining the above-described operational effects.

EXAMPLE

Hereinafter, an insulated wire in examples will be described with use of drawings. Here, the same reference numbers will be used to describe the same elements.

Example 1

An insulated wire in Example 1 will be described with use of FIG. 1. As shown in FIG. 1, an insulated wire 1 in the example includes a stranded wire conductor 2 and an insulator 3 that covers the outer circumference of the stranded wire conductor 2. In the following, this will be described in detail.

The insulated wire 1 is configured to be used in a state of being in contact with an oil composed of AT fluid or CVT fluid. The stranded wire conductor 2 is made up of at least a plurality of copper-based element wires 21 that are twisted together, and has been heat-treated after circular compression. The copper-based element wires 21 have a Ni-based plated layer (not illustrated) on the surface, and the Ni-based plated layer has been compressed by the circular compression. The insulator 3 is composed of a cross-linked ethylene-tetrafluoroethylene based copolymer.

In the example, the base material of the copper-based element wires 21 is composed of copper or a copper alloy. The Ni-based plated layer formed on the surface of the copper-based element wires 21 is composed of a Ni plate or a Ni alloy plate. In the example, the thickness of the Ni-based plated layer is 0.1 to 5.0 μm. The outer diameter of the copper-based element wires 21 is 0.1 to 0.15 mm in a state before being subjected to the circular compression.

In the stranded wire conductor 2 in the example, a tension member 22 for resisting tensile force is disposed at the conductor center. Specifically, the stranded wire conductor 2 includes the tension member 22 that is disposed at the conductor center, and an outermost layer 20 that is formed of the plurality of copper-based element wires 21 twisted together on the outer circumference of the tension member 22. Specifically, the tension member 22 is a stainless wire. The outer diameter of the tension member 22 is formed so as to be larger than the outer diameter of the copper-based element wires 21 in a state before being subjected to the circular compression, and specifically, is 0.2 to 0.3 mm. Specifically, the outermost layer 20 is formed of eight copper-based element wires 21 each of which has the Ni-based plated layer formed on the surface. In the stranded wire conductor 2, the conductor cross-sectional area is made to be 0.25 $mm^2$ or less by the circular compression.

In the example, the insulator 3 is composed of a cross-linked ethylene-tetrafluoroethylene copolymer (ETFE). The thickness of the insulator is in a range of 0.1 mm or more and 0.4 mm or less. The heating deformation rate of the insulator 3 is 65% or more, as calculated by the above-described method.

The insulated wire 1 can be produced, for example, in the following way.

The eight copper-based element wires 21 each having a circular cross-section and having the Ni-based plated layer formed on its surface are twisted together on the outer circumference of the tension member 22 having a circular cross-section. At the time of the twisting, the circular compression is performed in a radial direction of the stranded wire. By the circular compression, the Ni-based plated layer is compressed. After the circular compression, in order to soften the copper or the copper alloy forming the copper-based element wires 21, the heat treatment is performed under a temperature condition that is suitable for softening temperature of the copper or the copper alloy. Here, the temperature for the heat treatment is set to be lower than the melting point of the Ni plate or Ni alloy plate. For the heat treatment, an electrically heating method or the like can be adopted. In this way, the stranded wire conductor 2 can be prepared.

Next, a non-cross-linked ethylene-tetrafluoroethylene based copolymer is extruded so as to cover the outer circumference of the obtained stranded wire conductor 2. On this occasion, as the temperature for the extrusion molding, the optimal temperature that enables the extrusion covering with the non-cross-linked ethylene-tetrafluoroethylene based copolymer can be selected. Here, the temperature for the extrusion molding exceeds the melting point of the ethylene-tetrafluoroethylene based copolymer and is higher than the melting point of a Sn plate.

Next, a covering layer that covers the stranded wire conductor 2 is irradiated with an electron beam to cross-link the ethylene-tetrafluoroethylene based copolymer. The insulator 3 composed of the cross-linked ethylene-tetrafluoroethylene based copolymer is thereby formed. Thus, the insulated wire 1 can be obtained.

Next, the operational effects of the insulated wire in the example will be described.

The insulated wire 1 in the example includes the stranded wire conductor 2 that is made up of at least the plurality of copper-based element wires 21 twisted together and that has been heat-treated after circular compression. Further, in the stranded wire conductor 2, the copper-based element wires 21 have the Ni-based plated layer on the surface, and the Ni-based plated layer has been compressed by the circular compression. The Ni-based plate has a higher melting point than a Sn plate. Further, the melting point of Ni-based plate is higher than the softening temperature of the copper material forming the copper-based element wire 21 and the covering temperature at the time when the outer circumference of the stranded wire conductor 2 is covered with the insulator 3. Therefore, in the insulated wire 1 in the example, the Ni-based plated layer hardly melts due to the heat during the heat treatment for softening the copper material or the heat at the time of covering the outer circumference of the stranded wire conductor 2 with the insulator 3, and also hardly peels. Consequently, in the insulated wire 1 in the example, the conductor cross-sectional area of the stranded wire conductor 2 tends not to decrease due to the corrosion of the copper-based element wires 21 which has been caused by the high-temperature oil composed of AT fluid or CVT fluid, and the deterioration of the shock resistance can be reduced.

Further, the insulated wire 1 in the example includes the insulator 3 composed of the cross-linked ethylene-tetrafluoroethylene based copolymer. The cross-linked ethylene-tetrafluoroethylene based copolymer has a high strength, which results in excellent abrasion resistance. Thus, in the insulated wire in the example, the insulator 3 is good in abrasion resistance.

Furthermore, the cross-linked ethylene-tetrafluoroethylene based copolymer hardly deteriorates, even in the case of being exposed to the high-temperature oil. Thus, in the insulated wire 1 in the example, the insulator 3 hardly cracks even in the case where the insulated wire 1 is exposed to the high-temperature oil with being bent, and is once released from bending, and is once again bent.

A plurality of insulated wire samples having different configurations were prepared and evaluated as follows. An experimental example will be described.

Experimental Example

<Preparation of Material of Insulator>

As the material of the insulator, the following resins were prepared.

ETFE (ethylene-tetrafluoroethylene copolymer) ("Fluon (Registered Trademark) ETFE C-55AP" manufactured by Asahi Glass Co., Ltd.)

PTFE (tetrafluoroethylene resin) ("Fluon (Registered Trademark) PTFE CD097E" manufactured by Asahi Glass Co., Ltd.)

PFA (tetrafluoroethylene-perfluoroalkyl vinyl ether copolymer) ("NEOFLON (Registered Trademark) PFA AP230" manufactured by Daikin Industries, Ltd.)

FEP (tetrafluoroethylene-tetrafluoropropylene copolymer) ("NEOFLON (Registered Trademark) FEP AP230" manufactured by Daikin Industries, Ltd.)

PP (polypropylene) ("NOVATEC PP EA9" manufactured by Japan Polypropylene Corporation)

<Preparation of Sample Insulated Wires Referred to as Sample 1 to Sample 5 and Sample 7 to Sample 10>

As shown in Table 1, eight copper-based element wires each of which had a predetermined outer diameter and each of which had a Ni-base plated layer formed of a Ni plate on the surface were twisted together on the outer circumference of a stainless wire as a tension member having a predetermined outer diameter, to prepare a stranded wire material. As shown in Table 1, at the time of forming the stranded wire material, the stranded wire material was subjected to the circular compression, so as to have a predetermined conductor cross-sectional area. Subsequently, electric heating was applied to the stranded wire material subjected to the circular compression, by energizing with current of 20 A at voltage of 20 V for 1 second, so that the copper-based element wires were softened. Thus, each stranded wire conductor to be used for manufacturing insulated wires referred to as Sample 1 to Sample 5 and Sample 7 to Sample 10 was prepared.

Then, the ETFE as the material of the insulator was extruded so as to cover the outer circumference of the stranded wire conductor to form a covering layer. Subsequently, the covering layer was irradiated with an electron beam, and the ETFE was thereby cross-linked to form the insulator. Here, the temperature at the time of the extrusion molding was set to a temperature exceeding the melting point of the insulator material in use and being appropriate for forming the insulators having predetermined thicknesses shown in Table 1. Further, the degree of the cross-linkage in the ETFE was controlled by changing the irradiance level of the electron beam. Thus, the insulated wires referred to as Sample 1 to Sample 5 and Sample 7 to Sample 10 were prepared.

<Preparation of Insulated Wire Referred to as Sample 6>

As shown in Table 1, an insulated wire referred to as Sample 6 was prepared in the same way as the insulated wires referred to as Sample 1 to Sample 5 and Sample 7 to Sample 10, except that the tension member was not used and seven copper-based element wires each of which had a predetermined outer diameter and each of which had the Ni-based plated layer formed of the Ni plate on the surface were twisted together to prepare a stranded wire material.

<Preparation of Insulated Wire Referred to as Sample 11>

As shown in Table 1, an insulated wire referred to as Sample 11 was prepared in the same way as the insulated wires referred to as Sample 1 to Sample 5 and Sample 7 to Sample 10, except that the tension member was not used and seven copper-based element wires each of which had a predetermined outer diameter and each of which had the Ni-based plated layer formed of the Ni plate on the surface were twisted together to prepare a stranded wire material.

<Preparation of Insulated Wires Referred to as Sample 1C to Sample 9C>

Insulated wires referred to as Sample 1C to Sample 9C were prepared by changing the preparation conditions in the insulated wires referred to as Sample 1 to Sample 5 and Sample 7 to Sample 10, respectively to the preparation conditions shown in Table 2.

<Shock Resistance Evaluation for Insulated Wire>

Figure 2:
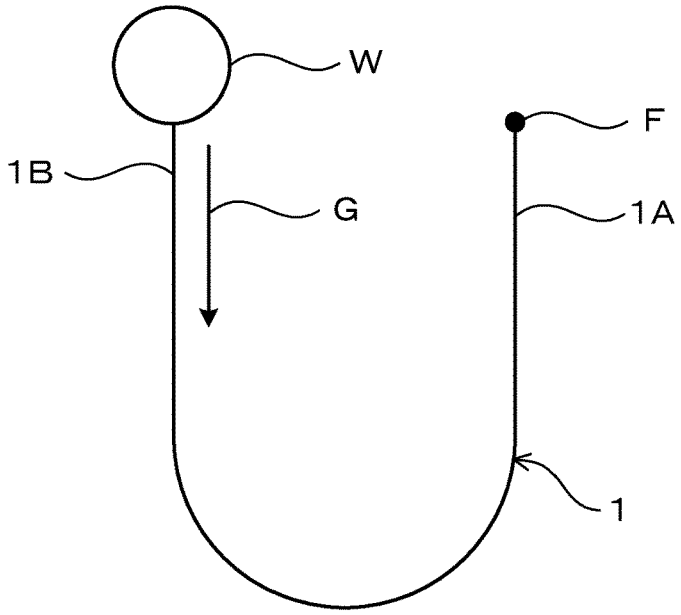
FIG. 2 is an explanatory diagram schematically showing a method of shock resistance evaluation for the insulated wire in an experimental example.

Each of the obtained insulated wire was immersed in AT fluid ("DEXIRON-VI" manufactured by Kendall Refining Company) at 150° C. for 2000 hours, being kept in an extended state. Thereafter, the following shock resistance test was performed, and the shock resistance energy was calculated. That is, as shown in FIG. 2, a first end 1A of the insulated wire 1 was fixed (a fixing point F), and a weight W having a predetermined weight was attached to a second end 1B on the opposite side to the first end 1A. Subsequently, the weight W at the second end 1B was made fall freely in a vertical direction (an arrow G). Such operation was repeated until the insulated wire 1 was broken, while gradually increasing the weight of the weight W. Then, the weight of the weight W at the time when the insulated wire 1 was broken was defined as a maximum load M, and the shock resistance energy was calculated on the basis of the following calculation formula.

Shock Resistance Energy [$J$]=Maximum Load $M$ [kg]×Gravitational Acceleration $g$ [m/s$^2$]×Fall Length $L$ [m]

In the case where the shock resistance energy was 10 [J] or more, the insulated wire was determined as passing and rated as "A". In the case where the shock resistance energy was 5 [J] or more and less than 10 [J], the insulated wire was determined as passing and rated as "B". In the case where the shock resistance energy was less than 5 [J], the insulated wire was determined as failure and rated as "C".

<Abrasion Resistance Evaluation for Insulator of Insulated Wire>

The abrasion resistance of the insulator of each obtained insulated wire was evaluated by a blade reciprocating method in conformity with ISO6722. That is, a specimen having a length of 600 mm was sampled from the insulated wire. Subsequently, on the surface of the insulator in the specimen, a blade was reciprocated in the axial direction for a length of 15 mm or more at speed of 60 times per minute under the environment of 23° C. On this occasion, the load to be applied to the blade was 7 N. Then, the reciprocation number until the blade being in contact with the stranded wire conductor was counted. The test was conducted for each specimen four times. In the case where the minimum reciprocation number counted in the tests conducted four times was 150 or more, the insulated wire was determined as passing and rated as "A". In the case where the minimum reciprocation number was 100 or more and less than 150, the insulated wire was determined as passing and rated as "B". In the case where the minimum reciprocation number is less than 100, the insulated wire was determined as failure and rated as "C".

<Crack Resistance Evaluation for Insulator of Insulated Wire>

Figure 3A:
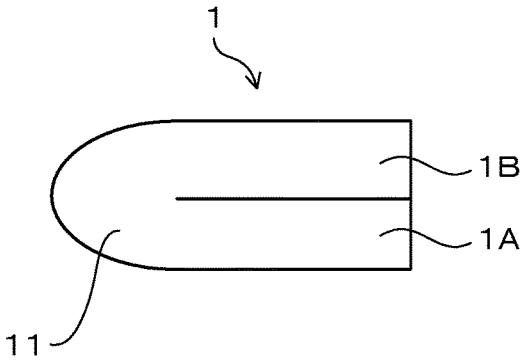
FIG. 3 is an explanatory diagram schematically showing a method of crack resistance evaluation for an insulator in the experimental example.
Figure 3B:
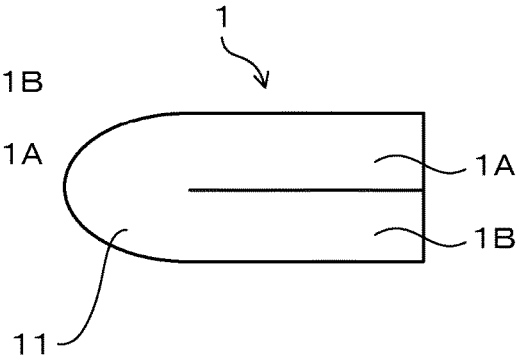

As shown in FIG. 3(*a*), the obtained insulated wire 1 was bent by 180° at a middle portion in the longitudinal direction to form a bent portion 11. The bent portion 11 was a 180° bent portion formed by bending by 180°. Subsequently, the insulated wire 1 was immersed in the AT fluid ("DEXIRON-VI" manufactured by Kendall Refining Company) at 150° C. for 100 hours, being kept in the state of being bent by 180°. Subsequently, the insulated wire 1 was taken out of the AT fluid and was once restored from the state of being bent to the extended state, and then the insulated wire 1 was bent by 180° at the same portion as bent at the previous time, but reversely in the direction as shown in FIG. 3(*b*). Thereafter, such bending was repeated.

In the case where no crack was visually recognized in the insulator even when the 180° bending operation was repeated 10 times or more, the insulated wire was determined as passing "A+". In the case where no crack was visually recognized in the insulator even when the 180° bending operation was repeated 3 times or more, the insulated wire was judged as passing "A". In the case where no crack was visually recognized in the insulator when the 180° bending operation was performed once, the insulated wire was judged as passing "B". In the case where a crack was visually recognized in the insulator when the 180° bending action was performed once, the insulated wire was judged as failure "C".

The detailed configuration and evaluation result for each insulated wire are shown in Table 1 and Table 2.

TABLE 1

| | | | Samples | | | | | |
|---|---|---|---|---|---|---|---|---|
| | | | 1 | 2 | 3 | 4 | 5 | 6 |
| Insulated Wire | Stranded Wire Conductor | Plating Material for Copper-based Element Wire | Ni | Ni | Ni | Ni | Ni | Ni |
| | | Heat Treatment | Done | Done | Done | Done | Done | Done |
| | | Tension Member | Included | Included | Included | Included | Included | None |
| | | Conductor Cross-sectional Area (mm$^2$) | 0.13 | 0.13 | 0.13 | 0.22 | 0.22 | 0.3 |
| | | Outer Diameter of Tension Member before Circular Compression (mm) | 0.225 | 0.225 | 0.225 | 0.225 | 0.225 | — |
| | | Outer Diameter of Copper-based Element Wire before Circular Compression (mm) | 0.14 | 0.14 | 0.14 | 0.18 | 0.18 | 0.26 |
| | Insulator | Material of Insulator | ETFE | ETFE | ETFE | ETFE | ETFE | ETFE |
| | | Cross-linkage | Cross linked | Cross linked | Cross linked | Cross linked | Cross linked | Cross linked |
| | | Heating Deformation Rate of Insulator (%) | 72 | 70 | 73 | 73 | 74 | 74 |
| | | Thickness of Insulator (mm) | 0.25 | 0.15 | 0.35 | 0.25 | 0.35 | 0.25 |
| Evaluation | Shock Resistance of Insulated Wire | | A | A | A | A | A | A |
| | Abrasion Resistance of Insulator | | A | A | A | A | A | A |
| | Crack Resistance of Insulator | | A+ | A+ | A+ | A+ | A+ | A |

| | | | Samples | | | | |
|---|---|---|---|---|---|---|---|
| | | | 7 | 8 | 9 | 10 | 11 |
| Insulated Wire | Stranded Wire Conductor | Plating Material for Copper-based Element Wire | Ni | Ni | Ni | Ni | Ni |
| | | Heat Treatment | Done | Done | Done | Done | Done |
| | | Tension Member | Included | Included | Included | Included | None |
| | | Conductor Cross-sectional Area (mm$^2$) | 0.13 | 0.13 | 0.13 | 0.13 | 0.13 |

TABLE 1-continued

| | | | | | | | |
|---|---|---|---|---|---|---|---|
| | | Outer Diameter of Tension Member before Circular Compression (mm) | 0.225 | 0.225 | 0.225 | 0.225 | — |
| | | Outer Diameter of Copper-based Element Wire before Circular Compression (mm) | 0.14 | 0.14 | 0.14 | 0.14 | 0.16 |
| | Insulator | Material of Insulator | ETFE | ETFE | ETFE | ETFE | ETFE |
| | | Cross-linkage | Cross linked | Cross linked | Cross linked | Cross linked | Cross linked |
| | | Heating Deformation Rate of Insulator (%) | 74 | 70 | 68 | 64 | 72 |
| | | Thickness of Insulator (mm) | 0.40 | 0.10 | 0.25 | 0.25 | 0.25 |
| Evaluation | Shock Resistance of Insulated Wire | | A | A | A | A | B |
| | Abrasion Resistance of Insulator | | A | B | B | B | A |
| | Crack Resistance of Insulator | | A | A+ | A | B | A+ |

TABLE 2

| | | | Samples | | | | |
|---|---|---|---|---|---|---|---|
| | | | 1C | 2C | 3C | 4C | 5C |
| Insulated Wire | Stranded Wire Conductor | Plating Material for Copper-based Element Wire | Sn | Ni | Ni | Ni | Ni |
| | | Heat Treatment | Done | Not done | Done | Done | Done |
| | | Tension Member | Included | Included | Included | Included | Included |
| | | Conductor Cross-sectional Area ($mm^2$) | 0.13 | 0.13 | 0.13 | 0.13 | 0.13 |
| | | Outer Diameter of Tension Member before Circular Compression (mm) | 0.225 | 0.225 | 0.225 | 0.225 | 0.225 |
| | | Outer Diameter of Copper-based Element Wire before Circular Compression (mm) | 0.14 | 0.14 | 0.14 | 0.14 | 0.14 |
| | Insulator | Material of Insulator | ETFE | ETFE | PTFE | PFA | FEP |
| | | Cross-linkage | Cross linked | Cross linked | None | None | None |
| | | Heating Deformation Rate of Insulator (%) | 70 | 70 | — | — | — |
| | | Thickness of Insulator (mm) | 0.25 | 0.25 | 0.25 | 0.25 | 0.25 |
| Evaluation | Shock Resistance of Insulated Wire | | C | C | A | A | A |
| | Abrasion Resistance of Insulator | | A | A | C | C | C |
| | Crack Resistance of Insulator | | A+ | A+ | C | C | C |

| | | | | Samples | | | |
|---|---|---|---|---|---|---|---|
| | | | | 6C | 7C | 8C | 9C |
| | Insulated Wire | Stranded Wire Conductor | Plating Material for Copper-based Element Wire | Ni | — | Ni | Sn |
| | | | Heat Treatment | Done | Done | Done | Done |
| | | | Tension Member | Included | Included | Included | Included |
| | | | Conductor Cross-sectional Area ($mm^2$) | 0.13 | 0.13 | 0.13 | 0.13 |
| | | | Outer Diameter of Tension Member before Circular Compression (mm) | 0.225 | 0.225 | 0.225 | 0.225 |
| | | | Outer Diameter of Copper-based Element Wire before Circular Compression (mm) | 0.14 | 0.14 | 0.14 | 0.14 |
| | | Insulator | Material of Insulator | ETFE | ETFE | FEP | PP |
| | | | Cross-linkage | None | Cross linked | None | None |
| | | | Heating Deformation Rate of Insulator (%) | — | 70 | — | — |
| | | | Thickness of Insulator (mm) | 0.25 | 0.25 | 0.40 | 0.25 |
| | Evaluation | Shock Resistance of Insulated Wire | | A | C | A | C |
| | | Abrasion Resistance of Insulator | | C | A | B | B |
| | | Crack Resistance of Insulator | | C | A+ | C | C |

From Table 1 and Table 2, the followings are found. That is, the insulated wire referred to as Sample 1C had a Sn plated layer on the surface of the copper-based element wires. Thus, due to the heat during the heat treatment for softening the copper material or the heat at the time of covering the outer circumference of the stranded wire conductor with the insulator by extrusion, the Sn plated layer melted and peeled. Consequently, in the insulated wire referred to as Sample 1C, due to the contact with the high-temperature AT fluid, corrosion of the copper-based element wires progressed, the conductor cross-sectional area of the stranded wire conductor decreased, and the shock resistance significantly deteriorated.

In the insulated wire referred to as Sample 2C, the stranded wire conductor not subjected to the heat treatment after the circular compression was used. Thus, in the insulated wire referred to as Sample 2C, the elongation of the stranded wire conductor is insufficient due to the work-hardening. In the insulated wire referred to as Sample 2C, the shock resistance was poor, accordingly.

In the insulated wires referred to as Sample 3C to Sample 5C, fluororesins other than the ethylene-tetrafluoroethylene based copolymer were used as the insulating material, and the fluororesins were not cross-linked. Consequently, in the insulated wires referred to as Sample 3C to Sample 5C, the insulator of each insulated wire was inferior in abrasion resistance. Further, in the insulated wires referred to as Sample 3C to Sample 5C, the insulator easily cracked in the case where the insulated wires were exposed to the high-temperature AT fluid with being bent, and were once released from bending, and were once again bent.

In the insulated wire referred to as Sample 6C, the ethylene-tetrafluoroethylene based copolymer was used as the insulating material. However, the ethylene-tetrafluoroethylene based copolymer was not cross-linked. Thus, in the insulated wire referred to as Sample 6C, similarly to the insulated wires referred to as Sample 3C to Sample 5C, the insulator of each insulated wire was inferior in abrasion resistance. Further, in the insulated wire referred to as Sample 6C, similarly to the insulated wires referred to as Sample 3C to Sample 5C, the insulator easily cracked in the case where the insulated wires were exposed to the high-temperature AT fluid with being bent, and were once released from bending, and were once again bent.

The insulated wire referred to as Sample 7C had no plated layer on the surface of the copper-based element wires forming the stranded wire conductor. Thus, in the insulated wire referred to as Sample 7C, due to the contact with the high-temperature AT fluid, the corrosion of the copper-based element wires progressed, the conductor cross-sectional area of the stranded wire conductor decreased, and the shock resistance significantly deteriorated.

In the insulated wire referred to as Sample 8C, FEP, which is a fluororesin other than the ethylene-tetrafluoroethylene based copolymer, was used as the insulating material, and the FEP was not cross-linked. Therefore, in the insulated wire referred to as Sample 8C, the insulator easily cracked in the case where the insulated wire was exposed to the high-temperature AT fluid with being bent, and was once released from bending, and was once again bent. Here, the reason why the insulator of the insulated wire referred to as Sample 8C was determined as passing with respect to the abrasion resistance is because the insulator was formed so as to have larger thickness as compared with the other insulators.

The insulated wire referred to as Sample 9C had a Sn plated layer on the surface of the copper-based element wires, and PP of which the temperature for extrusion molding is low, was used as the insulating material. Thus, the insulated wire referred to as Sample 9C made it possible to avoid the Sn plated layer from melting and peeling due to the heat at the time of covering the outer circumference of the stranded wire conductor with the insulator by extrusion. However, in the insulated wire referred to as Sample 9C, the Sn plated layer melted and the Sn-based plated layer peeled due to the heat applied at the time of the heat treatment for softening the copper material. Consequently, in the insulated wire referred to as Sample 9C, due to the contact with the high-temperature AT fluid, the corrosion of the cooper-based element wires progressed, the conductor cross-sectional area of the stranded wire conductor decreased, and the shock resistance significantly deteriorated. Further, the PP greatly deteriorates due to the high-temperature AT fluid. Thus, in the insulated wire referred to as Sample 9C, the insulator easily cracked in the case where the insulated wires were exposed to the high-temperature AT fluid with being bent, and were once released from bending, and were once again bent.

In contrast, the insulated wires referred to as Sample 1 to Sample 11 were configured as described above. Thus, the insulated wires referred to as Sample 1 to Sample 11 made it possible to reduce the deterioration of the shock resistance due to the corrosion of the copper-wire element wires caused by the high-temperature AT fluid. Further, in the insulated wires referred to as Sample 1 to Sample 11, the insulator of each insulated wire exhibited a good abrasion resistance. Further, in the insulated wire referred to as Sample 1 to Sample 11, the insulator hardly cracked in the case where the insulated wires were exposed to the high-temperature oil with being bent, and were once released from bending, and were once again bent.

Moreover, from the comparison among the insulated wires referred to as Sample 1 to Sample 11, the followings are found. That is, as apparent from the results about the insulated wires referred to as Sample 1 to Sample 3 and the insulated wire referred to as Sample 7, and the like, the crack resistance of the insulator is easily secured by adjusting the upper limit of the thickness of the insulator to 0.4 mm or less. This is because the reduced thickness of the insulator can easily reduce the load to be applied to the insulator when the insulated wire is bent.

Further, as apparent from the results about the insulated wire referred to as Sample 2 and the insulated wire referred to as Sample 8, and the like, it is found that the abrasion resistance of the insulator is easily secured by adjusting the lower limit of the thickness of the insulator to 0.1 mm or larger.

Further, as apparent from the results about the insulated wires referred to as Sample 1 to Sample 3 and the insulated wires referred to as Sample 9 and Sample 10, and the like, the effects of enhancing the abrasion resistance of the insulator and improving the crack resistance of the insulator are easily achieved by adjusting the heating deformation rate of the insulator to 65% or more. This is because the reduced thickness of the insulator can easily reduce the load to be applied to the insulator when the insulated wire is bent.

Further, as apparent from the results about the insulated wires referred to as Sample 1 to Sample 5 and the insulated wire referred to as Sample 6, and the like, the insulator more hardly cracks against the bending operations repeated after the insulated wire was exposed to the high-temperature oil in a state of being bent, by adjusting the conductor cross-sectional area of the stranded wire conductor to 0.25 $mm^2$ or less. This is because the load to be applied to the insulator by the bending is reduced in the case where the conductor cross-sectional area of the stranded wire conductor is 0.25 $mm^2$ or less.

Furthermore, as apparent from the results about the insulated wires referred to as Sample 1 to Sample 3 and the insulated wire referred to as Sample 11, and the like, the shock resistance of the insulated wire is easily enhanced in the case where the stranded wire conductor includes the tension member.

Thus, the examples of the present design have been described in detail, but the present invention is not limited to the aforementioned examples, and various modifications are possible as long as the spirit of the present invention is not impaired.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. An insulated wire comprising a stranded wire conductor, and an insulator that covers an outer circumference of the stranded wire conductor, wherein the insulated wire is configured to be used in a state of being in contact with an oil composed of AT fluid or CVT fluid, the stranded wire conductor is made up of at least a plurality of copper-based element wires that are twisted together, and has been heat-treated after circular compression, the copper-based element wires have an Ni-based plated layer on a surface thereof, the Ni-based plated layer has been compressed by the circular compression, and the insulator is composed of a cross-linked ethylene-tetrafluoroethylene based copolymer and a heating deformation rate of the insulator depends on the degree of cross-linking of the ethylene-tetrafluoroethylene based copolymer and is 65% or more at the time after an edge of 0.7 mm in thickness is pressed against a surface of the insulator with a Load defined by Formula 1 and is kept under an atmosphere at 220° C. for 4 hours in conformity with ISO6722, $$\text{Load } [N]=0.8\times\sqrt{\{i\times(2D-i)\}} \quad \text{(Formula 1)}$$

where, D is a finished outer diameter [mm] of the insulated wire, and i is a thickness [mm] of the insulator, and the heating deformation rate is obtained by Formula 2, Heating Deformation Rate (%)=100×(Minimum Wire Outer Diameter [mm] after subjected to Heating Deformation−Outer Diameter [mm] of Stranded Wire Conductor)/(Wire Outer Diameter [mm] before being subjected to Heating Deformation−Outer Diameter [mm] of Stranded Wire Conductor) (Formula 2).

2. The insulated wire according to claim 1, wherein a thickness of the insulator is in a range of 0.1 mm or more and 0.4 mm or less.

3. The insulated wire according to claim 2, wherein a conductor cross-sectional area of the stranded wire conductor is 0.25 $mm^2$ or less.

4. The insulated wire according to claim 3, wherein the stranded wire conductor comprises a tension member for resisting tensile force at a conductor center.

5. The insulated wire according to claim 4, wherein the insulated wire is configured to form a bent portion by bending when in use.

6. The insulated wire according to claim 3, wherein the insulated wire is configured to form a bent portion by bending when in use.

7. The insulated wire according to claim 2, wherein the stranded wire conductor comprises a tension member for resisting tensile force at a conductor center.

8. The insulated wire according to claim 2, wherein the insulated wire is configured to form a bent portion by bending when in use.

9. The insulated wire according to claim 1, wherein a thickness of the insulator is in a range of 0.15 mm or more, and 0.35 mm or less.

10. The insulated wire according to claim 9, wherein a conductor cross sectional area of the stranded wire conductor is 0.25 $mm^2$ or less.

11. The insulated wire according to claim 10, wherein the stranded wire conductor comprises a tension member for resisting tensile force at a conductor center.

12. The insulated wire according to claim 10, wherein the insulated wire is configured to form a bent portion by bending when in use.

13. The insulated wire according to claim 9, wherein the stranded wire conductor comprises a tension member for resisting tensile force at a conductor center.

14. The insulated wire according to claim 9, wherein the insulated wire is configured to form a bent portion by bending when in use.

15. The insulated wire according to claim 1 wherein a conductor cross-sectional area of the stranded wire conductor is 0.25 $mm^2$ or less.

16. The insulated wire according to claim 15, wherein the stranded wire conductor comprises a tension member for resisting tensile force at a conductor center.

17. The insulated wire according to claim 15, wherein the insulated wire is configured to form a bent portion by bending when in use.

18. The insulated wire according to claim 1, wherein the stranded wire conductor comprises a tension member for resisting tensile force at a conductor center.

19. The insulated wire according to claim 18, wherein the insulated wire is configured to form a bent portion by bending when in use.

20. The insulated wire according to claim 1, wherein the insulated wire is configured to form a bent portion by bending when in use.

21. The insulated wire according to claim 1, wherein the insulated wire has a first end, a second end, and a bent portion between the first end and the second end.

* * * * *